US007029293B2

(12) United States Patent
Shapson et al.

(10) Patent No.: US 7,029,293 B2
(45) Date of Patent: Apr. 18, 2006

(54) GROUND BLOCK CONNECTOR

(75) Inventors: Jay F. Shapson, Englishtown, NJ (US); Arthur Dyck, Abbotsford (CA)

(73) Assignee: Extreme Broadband Engineering, LLC, Englishtown, NJ (US)

( * ) Notice: Subject to any disclaimer, the term of this patent is extended or adjusted under 35 U.S.C. 154(b) by 0 days.

(21) Appl. No.: 11/204,629

(22) Filed: Aug. 16, 2005

(65) Prior Publication Data

US 2006/0040531 A1 Feb. 23, 2006

Related U.S. Application Data

(60) Provisional application No. 60/603,146, filed on Aug. 20, 2004.

(51) Int. Cl.
*H01R 13/648* (2006.01)

(52) U.S. Cl. ..... 439/97; 439/812

(58) Field of Classification Search ..... 439/97, 439/727, 811, 812, 814, 735
See application file for complete search history.

(56) References Cited

U.S. PATENT DOCUMENTS

| | | | | |
|---|---|---|---|---|
| 3,715,707 | A | 2/1973 | Anderson | |
| 4,629,281 | A | 12/1986 | Krüger | |
| 4,795,377 | A | 1/1989 | Schmode et al. | 439/727 |
| 4,882,647 | A * | 11/1989 | Collins | 361/119 |
| 5,445,543 | A | 8/1995 | Williams | 439/727 |
| 5,674,079 | A | 10/1997 | Auclair | 439/92 |
| 5,934,818 | A * | 8/1999 | Schmitt et al. | 403/399 |
| 6,011,218 | A * | 1/2000 | Burek et al. | 174/40 CC |
| 6,339,190 | B1 * | 1/2002 | Chung | 174/50 |
| 6,475,038 | B1 | 11/2002 | Franck | 439/811 |

* cited by examiner

*Primary Examiner*—Tho D. Ta
*Assistant Examiner*—Vanessa Girardi
(74) *Attorney, Agent, or Firm*—Kenneth Watov; Watov & Kipnes, P.C.

(57) ABSTRACT

A ground block connector is provided by forming a slot in a protrusion of a housing for an electrical device. A compression bolt is screwed into a threaded hole in the protrusion into the slot, for captively retaining a U-shaped compression electrical contact in the slot, whereby movement of the screw in one direction moves the contact toward the bottom of the slot, for compressibly retaining an end of a ground wire between the bottom of the contact and bottom of the slot.

23 Claims, 11 Drawing Sheets

GROUND BLOCK CONNECTOR

RELATED APPLICATION

This Application is related to Ser. No. 60/603,146, filed Aug. 20, 2004, now abandoned for "Ground Block Connector," and takes priority therefrom. The teachings of the co-pending Application are incorporated herein to the extent they do not conflict herewith.

FIELD OF THE INVENTION

The present invention relates generally to the electrical connectors, and more particularly to connectors for receiving a ground cable or wire.

BACKGROUND OF THE INVENTION

It is important in providing ground connections to housings of electrical devices, between devices, and to other typical electrical installations, that the connectors used permit easy, efficient, and reliable connection to ground wire or cable terminations. Known connectors are prone to damage the bared ends of ground wires or cables, and as such require care in use. There is a need in the art for connectors that permit rapid and easy connection to ground wires or cables, while substantially avoiding damage to the terminating bared end of the wire or cables.

SUMMARY OF THE INVENTION

In one embodiment of the invention, a ground block connector is provided in an electrically conductive protrusion of an electrical device housing. The protrusion includes means for captively retaining a screw adapted for moving a compressive ground contact downward in an open slot, for compressively retaining and electrically connecting to a bared wire end of a ground wire or cable inserted between the bottom of the slot and the bottom of the ground contact.

BRIEF DESCRIPTION OF THE FIGURES

Various embodiments of the present invention are described in detail below with reference to the figures in which like items are identified by the same reference designation, wherein.

DETAILED DESCRIPTION OF THE INVENTION

Figure 1:
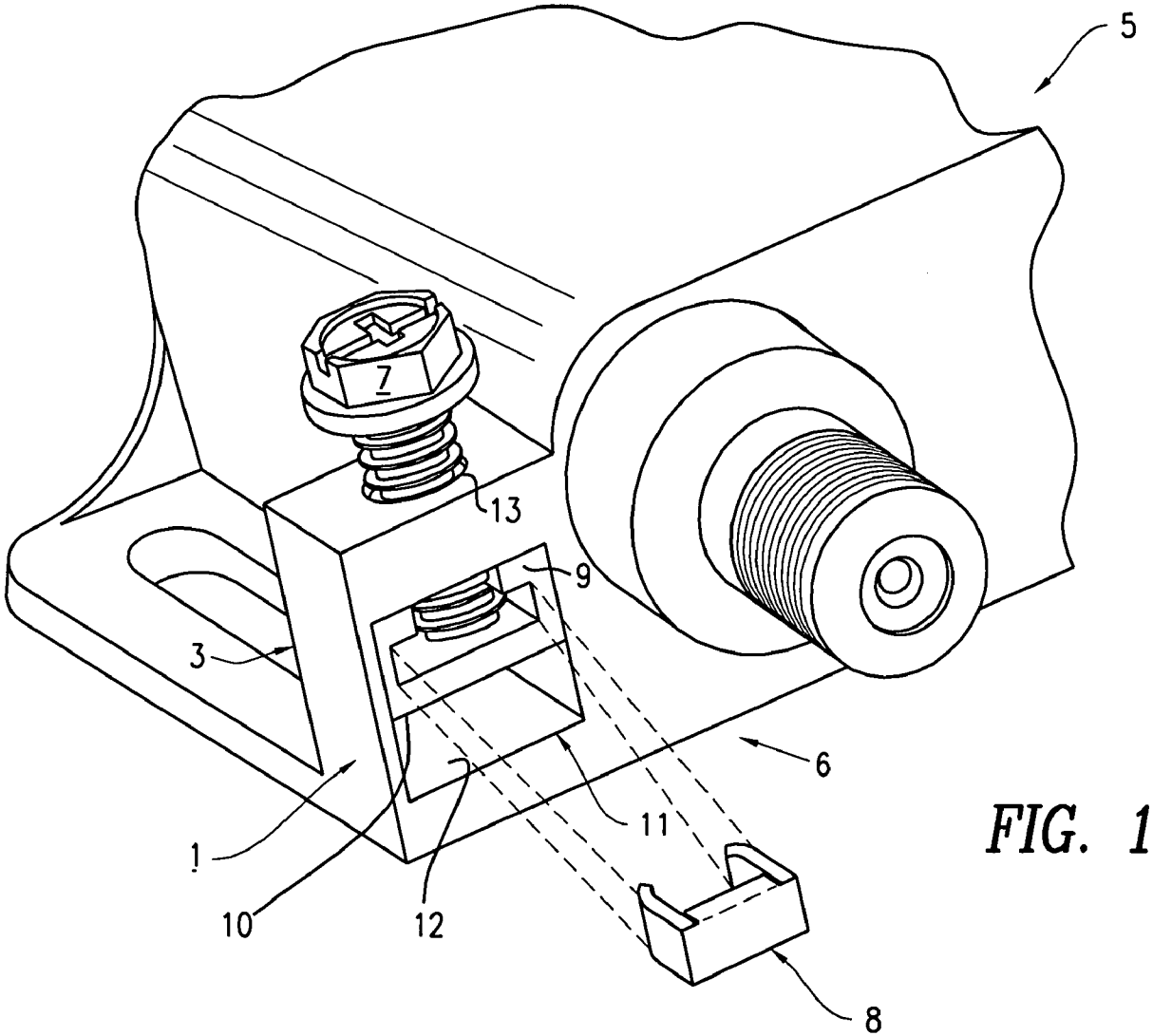
FIGS. 1 through 3 are pictorial diagrams of an embodiment of the invention, all shown in association with a portion of a housing of an electrical device.

The present invention provides a ground block connection that can be used with cable television devices, and other electrical devices, particularly those associated with housings for enclosing various electrical components. However, the invention is not meant to be so limited, and can in certain embodiments be used to provide a stand alone ground block connector, for example. With reference to FIGS. 1 through 4, in one embodiment of the invention, the ground block connector 1 is retained in a sidewall protrusion 3 from the main housing 6 of a cable television device 5, such as an amplifier or splitter, or from housings for other electrical devices, for example.

Figure 2:
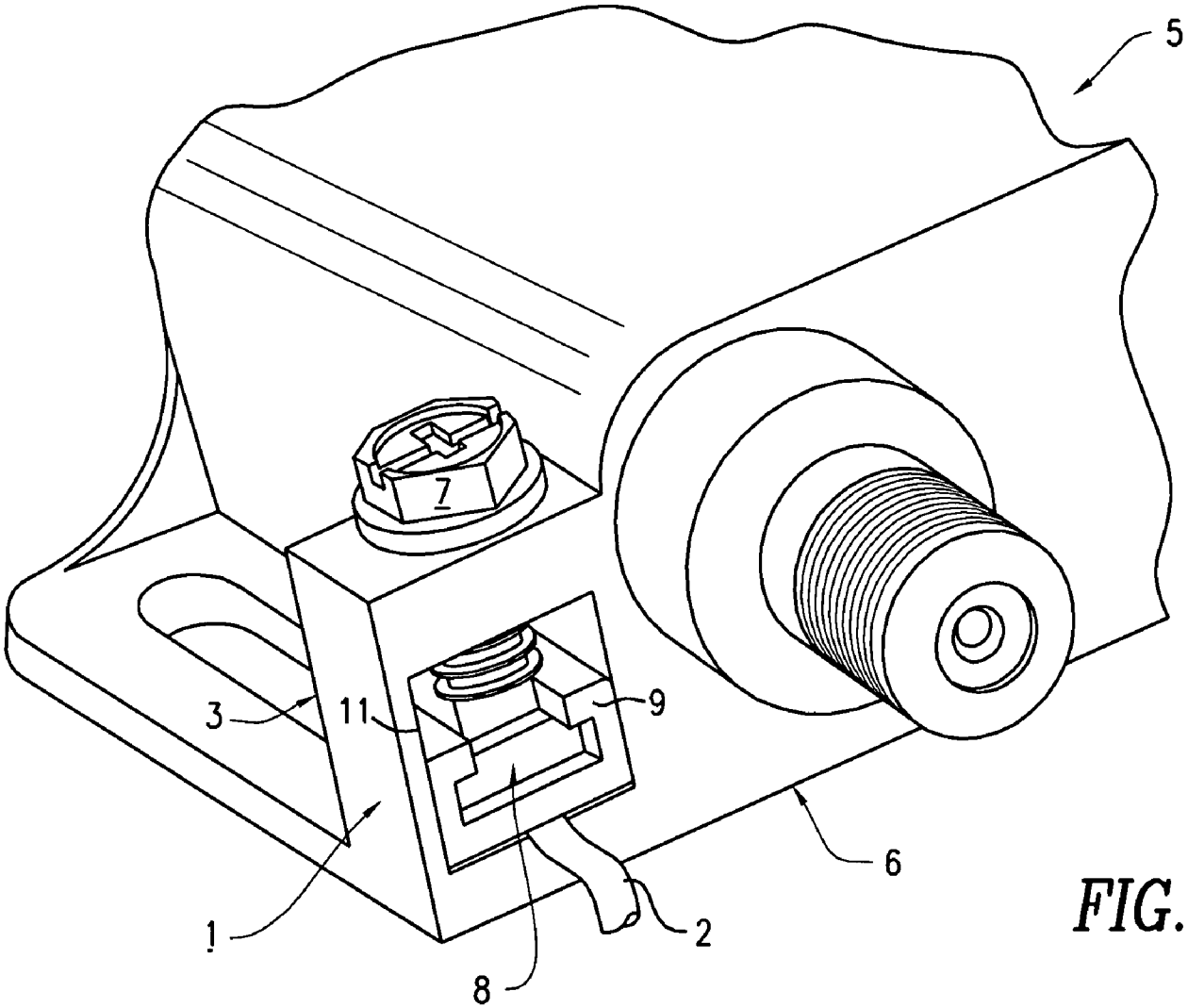
Figure 3:
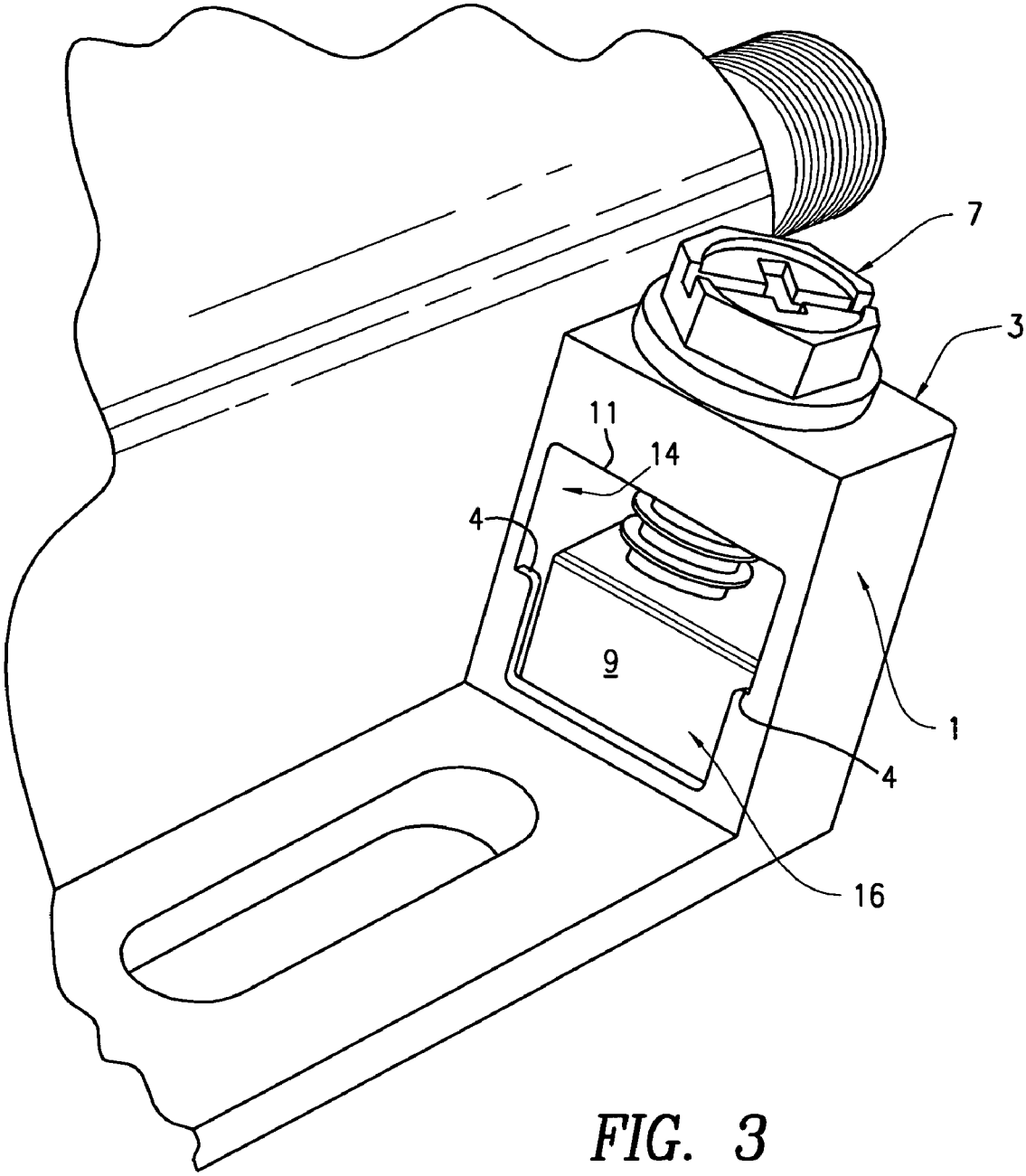
Figure 4:
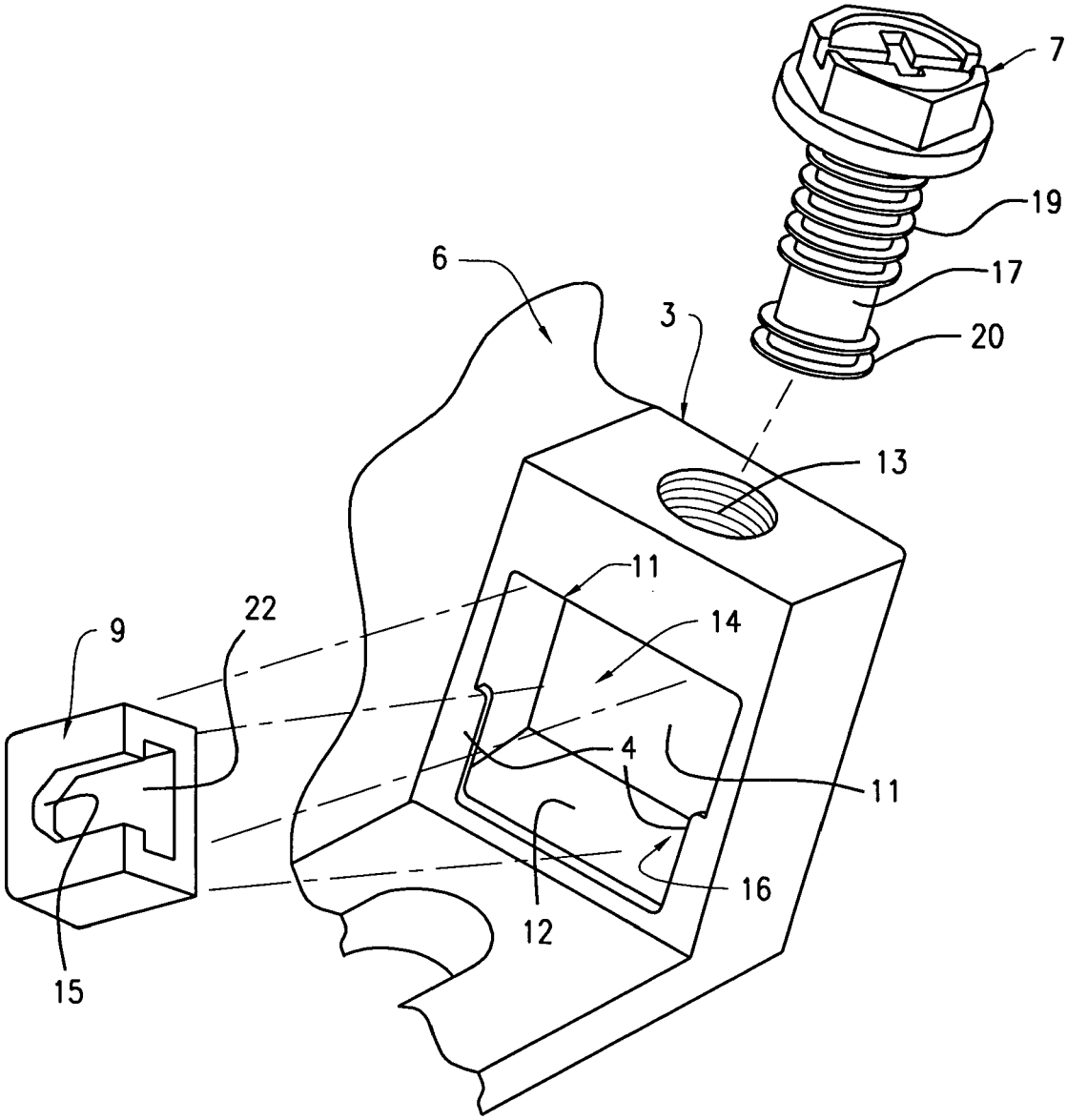
FIG. 4 is a pictorial exploded assembly diagram of an embodiment of the invention.
Figure 5:
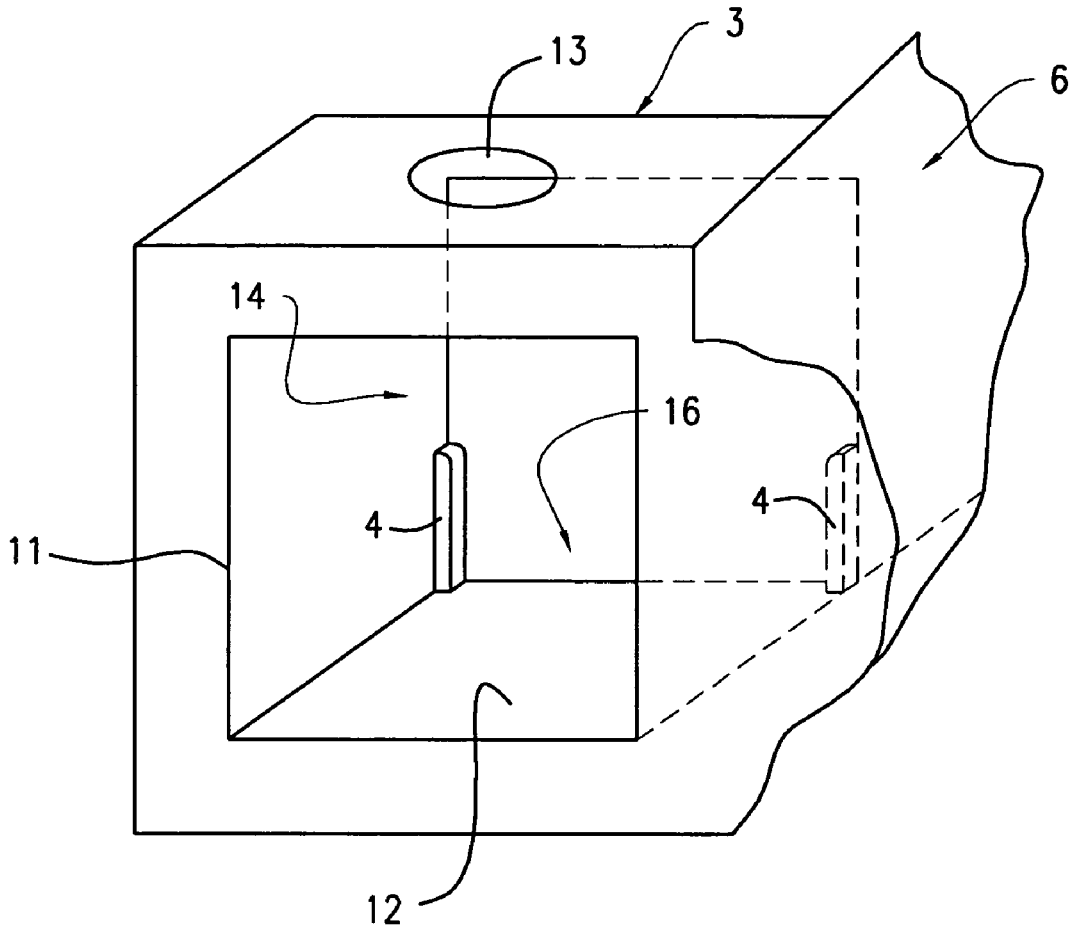
FIG. 5 is a partial pictorial view showing details of slot projections for an embodiment of the invention.
Figure 6A:
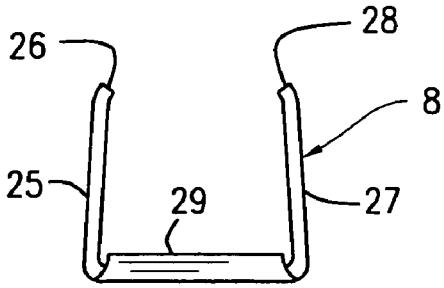
FIGS. 6A through 6D show top plan, bottom plan, right side elevational, and front elevational views of a retaining clip for an embodiment of the invention, the left side elevational view being a mirror image of the right side elevational view.
Figure 6C:
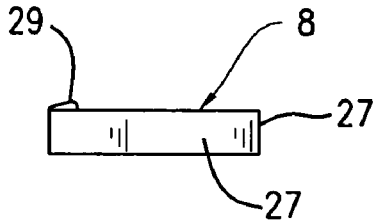
Figure 6B:
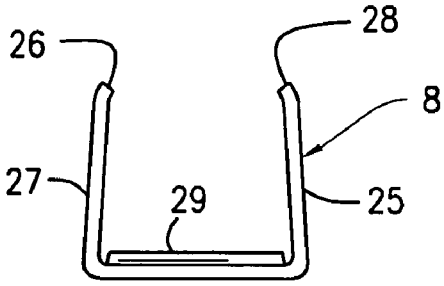
Figure 6D:
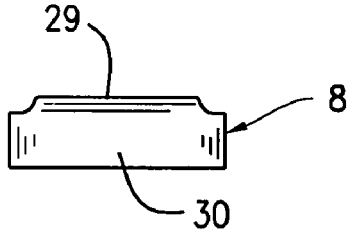

The ground connector block 1 is formed in an electrically conductive protrusion 3 from a housing 6 of an electrical device 5, in this example. More specifically as shown in FIG. 1, the ground connection connector block 1 includes a compression bolt or screw 7 that is rotated in one direction for moving a compression block or ground contact 9 downward in a slot 11, for compressing a bottom portion 10 of contact 9 against an electrical conductive wire (not shown), and a bottom portion 12 of slot 11, for securing the wire therein for grounding. In FIG. 1, the ground contact 9 is shown in an open position for permitting a wire end to be inserted in the open portion of slot 11. FIG. 2 shows the screw 7 having been rotated in the appropriate direction for moving the ground contact 9 downward in the slot 11, in this case for retaining the bared end of ground wire 2. As shown in FIGS. 3, 4, and 5, looking toward the back of the open slot 11, the slot is configured to be wider in its upper half portion 14 than its lower half portion 16, in order to permit the electrical contact 9 (see FIG. 4) to initially be inserted from the rear into upper portion 14 of the slot 11 above projections 4, after partially screwing a screw 7 into the threaded hole 13 in the top of the protrusion 3, whereby the U-shaped opening 15 on the top of the electrical contact 9 is pushed onto the unthreaded portion 17 of the screw 7, with the lowermost threads 20 of screw 7 being retained in the lower slot 22 of contact 9. As further shown, the screw 7 is then screwed in further to hold the electrical ground contact 9 captive in the lower portion 16 of the housing slot 11. The means for holding the contact 9 captive include the screw 7 preventing the contact 9 movement out of the front of slot 11, and two narrow projections or buttresses 4 formed in the opposing sides of the lower portion 16 of slot 11 to prevent removal of contact 9 from the back or rear of slot whenever any portion of contact 9 is positioned below the level of projections 4 (see FIGS. 4 and 5). The uppermost screw threads 19 are then utilized in conjunction with the mating threads in the central hole 13 at the top of the protrusion 3 for moving the electrical contact 9 up for freeing a previously installed ground wire 2 (see FIG. 2), or down in the slot 11, as previously described, for holding a bared ground wire end 2 captive between the bottom 10 of the electrical contact 9 and bottom 12 of slot 11 to provide a ground connection (see FIGS. 1 and 2). Typically, the housing 6 consists of an electrically conductive material, and the bottom 12 of slot 11 and bottom 10 of contact 9 and/or the electrical connection between the screw threads 19 and the threaded hole 13 in the center of the protrusion 3, provide a low resistance path to ground for electrical current between the ground wire 2 and the housing 6. Appropriate electrically conductive materials are used for the housing 6, bolt or screw 7, and compression block or ground contact 9, in this example, and each can be made from a single piece of material.

In another embodiment of the invention, after the ground contact 9 has been installed in the slot 11 and mounted on screw 7, as previously described (see FIGS. 1 and 2), a retaining clip 8 is pushed wholly into the lower slot 22 of ground contact 9, until the top folded lip 29 of retaining clip 8 is within the unthreaded portion 17 of screw 7. With reference to FIGS. 6A–6D, the retaining clip 8 right and left side arms 25, 27, respectively, have extreme portions of their free ends 26, 28, respectively, being bent inward, as shown, to ease installation. Also, the arms 25 and 27 are bent slightly toward one another both to ease installation, and to provide a width therebetween that is narrower than the outside diameter of the unthreaded portion 17 of bolt or screw 7, to retain clip 8 thereon. In this manner clip 8 is prevented from falling out from screw 7. The widest portion of retaining clip 8 between arms 25 and 27, proximate the front face 30 thereof, is slightly wider than the width of the lower slot 22 of ground contact 9, to insure a tight frictional fit of retaining clip 8 within the lower slot 22. The retaining clip 8 prevents the ground contact 9, after installation in the slot 11, from falling out of the upper half 14 of slot 11, at times that screw 7 is rotated to retaining clip 8 into that position in slot 11. The retaining clip 8 is made from any suitable metal or plastic material, and can be made from a single piece of material.

Figure 8:
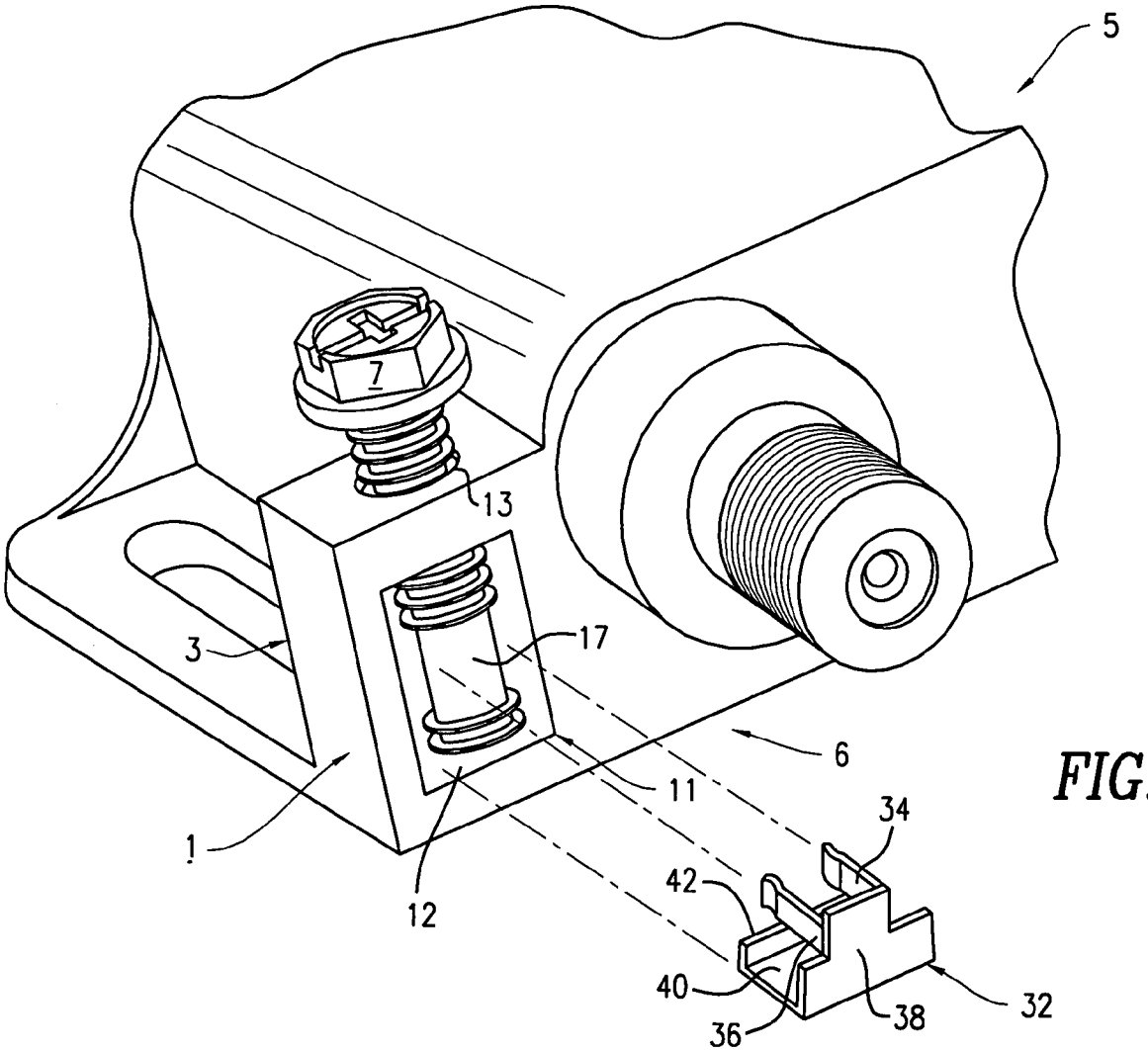
FIGS. 8 through 10 are pictorial diagrams of a preferred embodiment of the invention, all shown in association with a portion of a housing of an electrical device.
Figure 9:
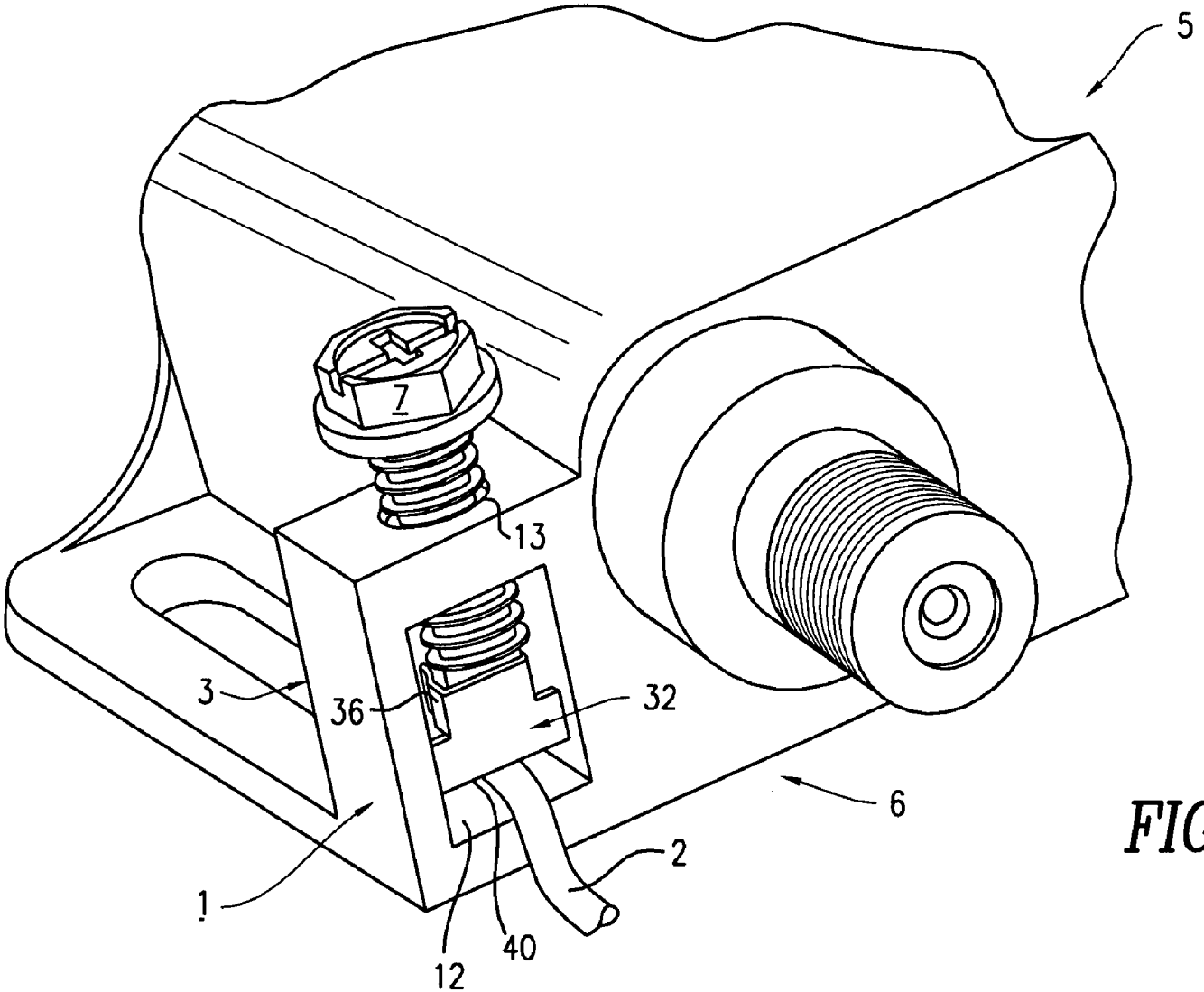
Figure 10:
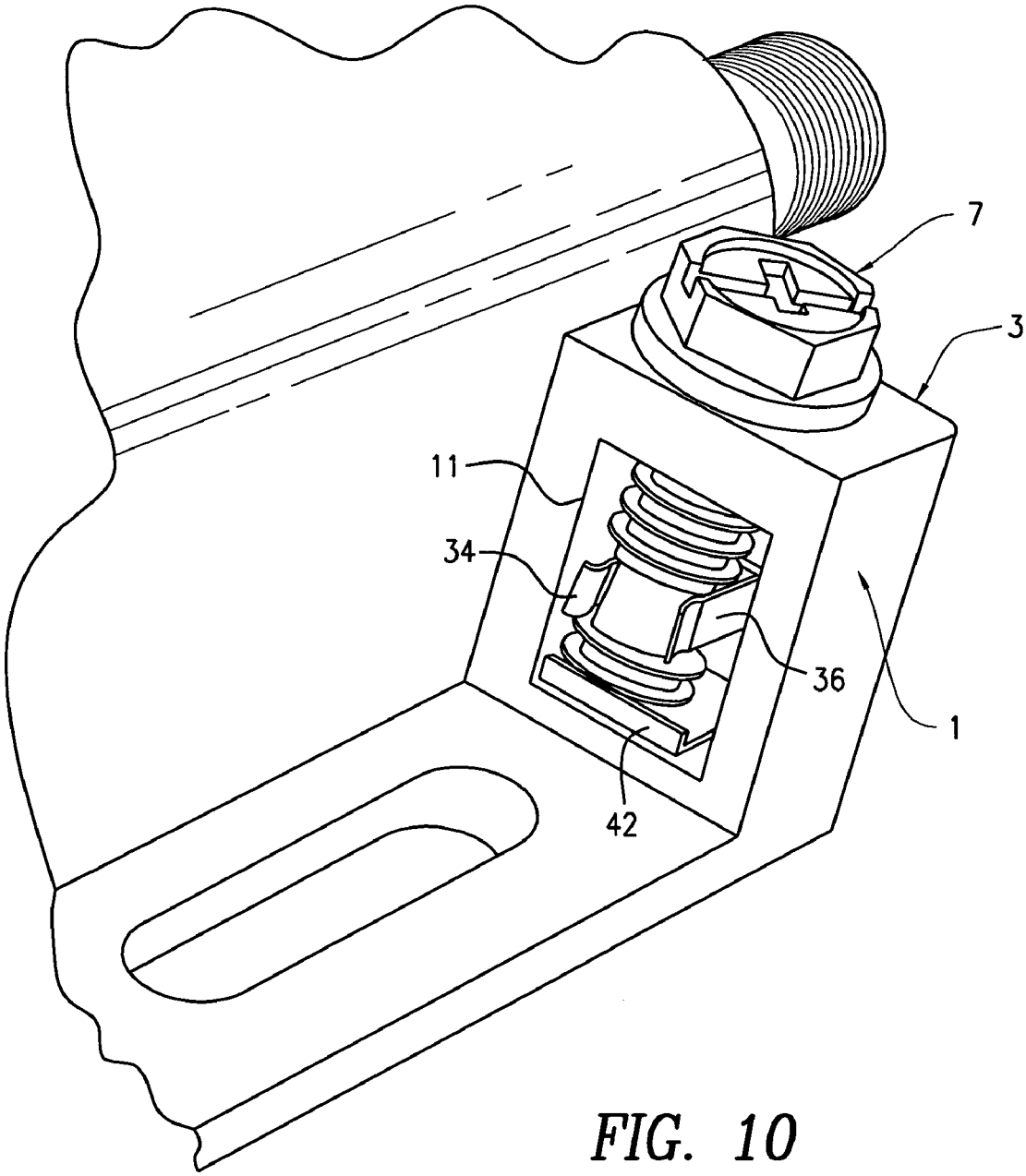

A preferred embodiment of the invention is shown in FIG. 8, and includes a combined ground block and clip 32. The clip 32 includes opposing resilient arms 34 and 36 extending from a uppermost portion of a back wall 38. The clip also includes a bottom portion 40 extending from the bottommost portion of the back wall 38 to a narrow front lip 42. The bottom portion 40 is spaced from the resilient arms 34 and 36 for an amount that is slightly greater than the length of the bottommost threaded portion 20 of screw 7. The combined ground block and clip 32 is installed on the screw 7, as shown in FIG. 8, by pushing it onto the screw 7 in a manner causing the resilient arms 34 and 36 to snap on and be firmly secured to the unthreaded portion 17 of screw 7, with a bottom of clip 32 proximate the bottom of screw 7, and the narrow front lip 42 adjacent and extending over the bottom portion of screw 7. Note that in this embodiment the slot 11 is narrower than in the previously described embodiments of the invention, and can be made slightly wider than the outside diameter of a threaded portions of the screw 7, but wide enough to accommodate the combined ground block and clip 32. In turn, the widest portion of the combined ground block and clip 32 can be made slightly narrower than the width of the slot 11. In FIG. 9, the combined ground block and clip 32 is shown installed on screw 7 and slot 11, along with being utilized to retain the bared end of a ground wire 2 between the bottom 40 of ground block/clip 32, and the bottom portion 12 of slot 11. Note that the operation of the combined ground block and clip 32 is substantially the same as for the previously described compression block or ground contact 9. Reference is further made to FIG. 10 looking toward the back of the slot 11 with the combined ground block and clip 32 installed on screw 7 within slot 11. Note that in this embodiment the slot 11 is not only narrower than in the previous embodiment, but also does not include a wider portion in its upper half as in the previous embodiment, thereby eliminating the projections 4 as used in the latter. Accordingly, in this embodiment of the invention, it is clearly simpler than the previously described embodiment, and completely eliminates any requirement for using a retaining clip, such as retaining a clip 8 as described above.

Figure 11A:
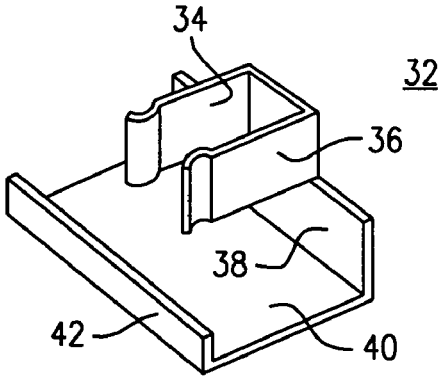
FIGS. 11A through 11E are a perspective view, a top plan view, a front elevational view, a right side elevational view, and a back elevational view, respectively, of a combined ground block and clip for a preferred embodiment of the invention.
Figure 11B:
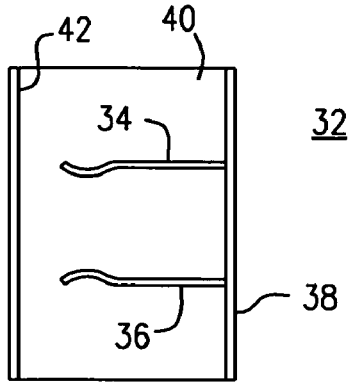
Figure 11C:
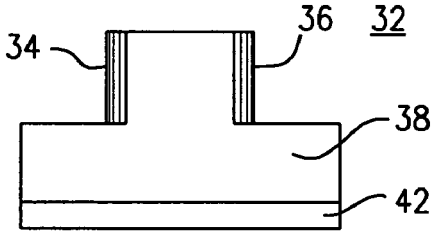
Figure 11D:
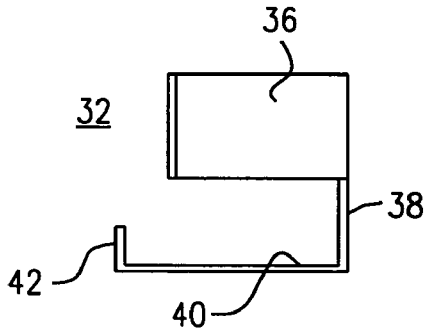
Figure 11E:
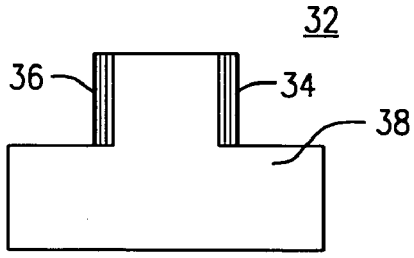

A perspective view of the combined ground block and clip 32 is shown in FIG. 11A. Note that in a top plan view thereof as shown in FIG. 11B, that the ends of the opposing resilient arms 34 and 36 initially bend inward, and then at their very ends bend outward, for facilitating the installation of ground block/clip 32 on to the screw 7. Note that the left side elevational view thereof is a mirror image of the right side elevational view shown in FIG. 11D. A back elevational view of the combined ground block and clip 32 is shown in FIG. 11E. The combined ground block and clip 32 can be made from a single piece of any suitable material, and of an appropriate thickness. For example, stainless steel having a thickness ranging from 0.25 to 0.4 millimeters can be used, and is acceptable for galvanic compatibility relative to the SCTE standard calling for use of a stainless steel screw 7 in this application, but the invention is not limited to this material or thickness.

Figure 7:
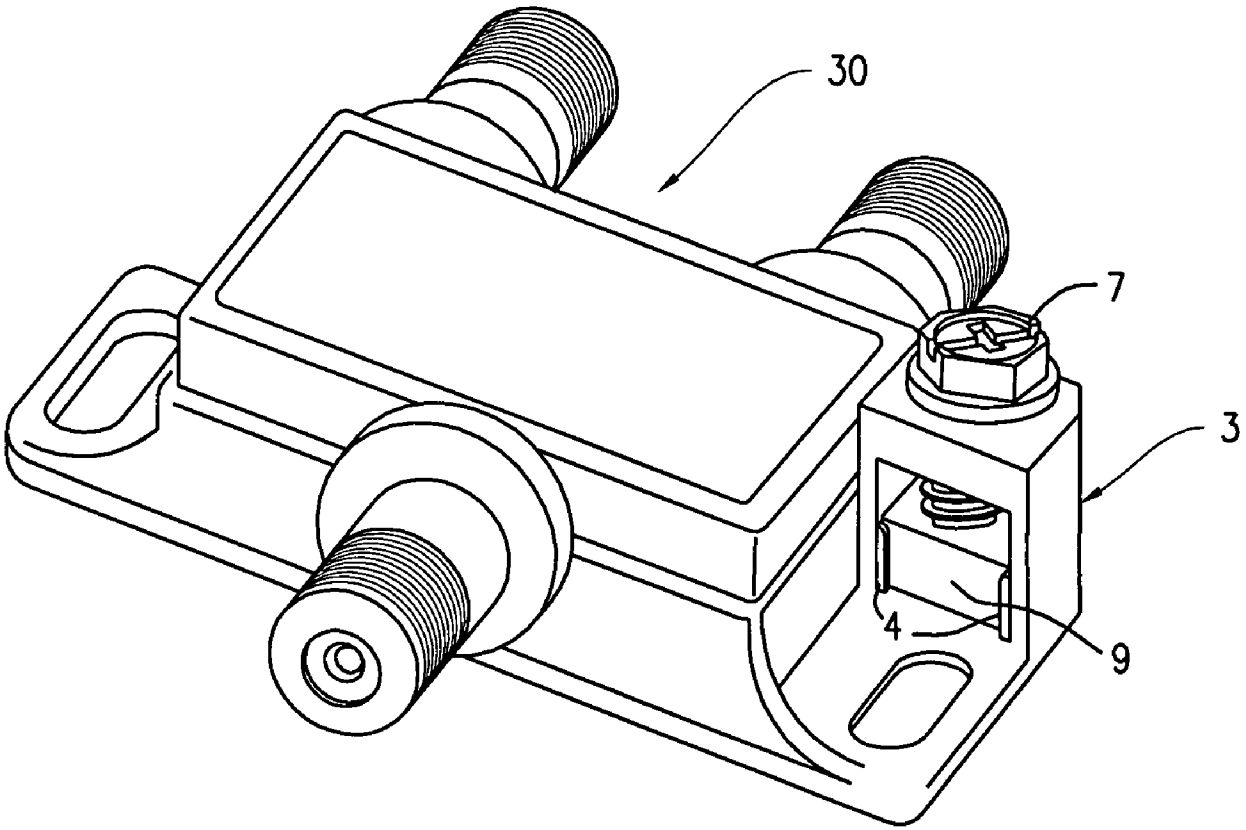
FIG. 7 is a pictorial diagram of an embodiment of the invention as used in association with an electrical digital splitter, for example.

Although various embodiments of the invention have been shown and described, they are not meant to be limiting. Those of skill in the art may recognize certain modifications to those embodiments, which modifications are meant to be covered by the spirit and scope of the appended claims. For example, the bolt or screw 7 can be installed through a threaded hole in the side of a housing protrusion 3 rather than in the top of the protrusion 3, with the slot 11 and electrical contact 9 or block/clip 32 being reoriented, accordingly. Also, as indicated, the present ground connector block 9 or block/clip 32 can be used on many different electrical device housings, such as that of FIG. 7 for a splitter, for example.

What is claimed is:

1. A ground block connector comprising:

a housing including an open slot, having a front, back, top, bottom, and opposing sides, and a threaded hole through said housing into said slot;

a compression bolt screwed into said threaded hole for entry into said slot;

a compression block electrical contact, said bolt, said housing, and said contact being configured for captively retaining said contact on said bolt within said slot, said screw can be turned in one direction for moving said contact upward, and in another direction for moving said contact downward to compress against and retain an electrically conductive end of a ground wire, or cable in the bottom of said slot, thereby grounding said housing; wherein said slot includes:

a first narrow projection proximate the back of said slot, extending from one side between the bottom of said slot and an upper intermediate portion;

a second narrow projection proximate the back of said slot, extending from another side between the bottom of said slot and said upper intermediate portion;

said first and second narrow projections each having a relatively narrow width compared to the width of said slot;

said upper intermediate portion of said slot being slightly longer than the height of said electrical contact, and having a wider width than said electrical contact, for permitting said electrical contact to be inserted into said slot above said first and second projections.

2. The ground block connector of claim 1, wherein said housing consists of a single piece of electrically conductive material.

3. The ground block connector of claim 1, wherein said compression bolt consists of electrically conductive material.

4. The ground block connector of claim 1, wherein said housing, compression bolt, and compression block electrical contact, each consist of a single piece of electrically conductive material.

5. The ground block connector of claim 1, further including:

said bolt having a head portion, and a shaft extending therefrom, said shaft having an upper threaded portion, a lowermost threaded portion, and an unthreaded portion therebetween;

said electrical contact being in the form of a shallow box having a closed bottom, side, and back portions, a partially closed top portion having a U-shaped centrally located cutout portion opening from a front portion of said contact, said contact further having a centrally located rectangular cavity that is wider than the U-shaped cutout and also is open at the front of said contact, the width of said U-shaped cutout being wider than the unthreaded portion of said bolt and narrower than the threaded portions thereof, and the height of the cutout being greater than the height of the lowermost threaded portion of said bolt;

said ground block connector being assembled by first installing said bolt into said threaded hole, and screwing said bolt downward into said open slot until the unthreaded portion of the shaft of said bolt is within said upper intermediate portion of said slot, whereafter the electrical contact is oriented to push it into the upper intermediate portion of said slot past said first and second narrow projections onto said bolt for having the lowermost threads thereof held captive in the cavity of said contact with the unthreaded portion of said bolt being located within the U-shaped cutout of said contact, thereby permitting said bolt to be turned in a given direction for moving the contact downward or upward in said slot, whereby when said bolt is turned to move said contact downward in said slot away from said upper intermediate portion and proximate said first and second narrow projections, said contact is captively retained in said slot.

6. The ground block connector of claim 5, wherein said electrical contact consists of a single piece of electrically conductive material.

7. The ground block connector of claim 5, wherein said housing, compression bolt, and compression block electrical contact, each consist of a single piece of electrically conductive material.

8. The ground block connector of claim 5, further including:

a retaining clip configured for installation in the cavity of said electrical contact as mounted on said bolt, for preventing said contact from falling off of the bolt and out of the upper intermediate portion of said slot, at times that said bolt is turned to move said contact into the upper intermediate portion of said slot.

9. The ground block connector of claim 8, wherein said housing, compression bolt, and compression block electrical contact, each consist of a single piece of electrically conductive material.

10. The ground block connector of claim 8, wherein said retaining clip consists of a single piece of metal material.

11. The ground block connector of claim 8, wherein said retaining clip consists of a single piece of plastic material.

12. The ground block connector of claim 8, wherein said retaining clip includes:

a front face;

right and left side arms opposing one another with each having a free end, and each being connected to opposite ends, respectively, of said front face; and a narrow top folded lip bent away from said front face between said right and left side arms;

the width of said front face being slightly wider than the rectangular cavity of said electrical contact, whereby said retaining clip is installed in said cavity by pushing said right and left arms into said cavity until said folded lip is located proximate the unthreaded portion of said bolt, with said front face being frictionally secured within said cavity.

13. The ground block connector of claim 12, wherein said housing, compression bolt, and compression block electrical contact, each consist of a single piece of electrically conductive material.

14. The ground block connector of claim 12, wherein said retaining clip consists of a single piece of material selected from the group consisting of a metal, and a plastic.

15. The ground block connector of claim 12, wherein said retaining clip further includes:

said right and left side arms being bent toward one another; and extreme end portions of each of said right and left side arms both being bent inward to facilitate the installation of said retaining clip into said cavity of said electrical contact, and having a width therebetween narrower than the outside diameter of the unthreaded portion of said bolt, for retaining said retaining clip on said bolt.

16. The ground block connector of claim 15, wherein said retaining clip consists of a single piece of material selected from the group consisting of a metal, and a plastic.

17. The ground block connector of claim 15, wherein said retaining clip consists of a single piece of material.

18. The ground block connector of claim 17, wherein the material for said retaining clip is selected from the group consisting of metal, and plastic.

19. The ground block connector of claim 1, further including:

said bolt having a head portion, and a shaft extending therefrom, said shaft having an upper threaded portion, a lowermost threaded portion, and an unthreaded portion therebetween;

said electrical contact including a bottom, a back portion extending upward from a back edge of said bottom portion, a pair of spaced apart opposing resilient arms extending outward from an uppermost portion of said back portion and over and spaced away from the bottom, said arms being configured for snapping onto the unthreaded portion of said bolt, and retaining said contact on said bolt, with the bottom of said contact proximate the bottom of said bolt.

20. The ground block connector of claim 19, wherein said electrical contact further includes:

a narrow upwardly extending front lip from the bottom, configured for being proximate the lowermost threaded portion of said bolt, when said contact is mounted thereon, said lip being for maintaining the orientation of said contact on said bolt.

21. The ground block connector of claim 19, wherein said electrical contact consists of a single piece of material.

22. The ground block connector of claim 21, wherein said material is stainless steel.

23. The ground block connector of claim 22, wherein said bolt consists of stainless steel material.

* * * * *